US012595805B2

(12) United States Patent
Collins et al.

(10) Patent No.: US 12,595,805 B2
(45) Date of Patent: Apr. 7, 2026

(54) SEAL CONFIGURATION FOR HIGH DENSITY LUBRICATION OILS

(71) Applicant: Baker Hughes Oilfield Operations LLC, Houston, TX (US)

(72) Inventors: Charles Collins, Oklahoma City, OK (US); Ryan Semple, Owasso, OK (US); Aron Meyer, Pryor, OK (US); David Tanner, Broken Arrow, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 268 days.

(21) Appl. No.: 18/234,807

(22) Filed: Aug. 16, 2023

(65) Prior Publication Data

US 2024/0060502 A1 Feb. 22, 2024

Related U.S. Application Data

(60) Provisional application No. 63/398,527, filed on Aug. 16, 2022.

(51) Int. Cl.

| | |
|---|---|
| ***F04D 29/08*** | (2006.01) |
| ***F04D 13/10*** | (2006.01) |
| ***F04D 29/06*** | (2006.01) |

(52) U.S. Cl.

CPC ..... *F04D 29/086* (2013.01); *F04D 13/10* (2013.01); *F04D 29/061* (2013.01)

(58) Field of Classification Search

CPC ..... F04D 13/086; F04D 13/10; F04D 29/106; F04D 29/00; F04D 29/007; F04D 29/08;

(Continued)

(56) References Cited

U.S. PATENT DOCUMENTS

| | | | |
|---|---|---|---|
| 7,182,584 | B2 | 2/2007 | Du et al. |
| 10,928,841 | B2 | 2/2021 | Tanner et al. |

(Continued)

FOREIGN PATENT DOCUMENTS

| | | | | |
|---|---|---|---|---|
| WO | WO-2016053588 | A1 * | 4/2016 | ..... F04B 47/06 |
| WO | 2021175526 | A1 | 9/2021 | |

OTHER PUBLICATIONS

Author: Riya Veluri Title: Density of Oil Date published: Feb. 22, 2022 Date accessed: Jun. 25, 2025 Link: https://www.tribonet.org/wiki/density-of-lubricating-oil/ (Year: 2022).*

(Continued)

*Primary Examiner* — Essama Omgba
*Assistant Examiner* — Chirag Jariwala
(74) *Attorney, Agent, or Firm* — Baker Hughes Company

(57) ABSTRACT

A seal section for use in a downhole submersible pumping system includes a lower chamber, an upper chamber and an intermediate guide section between the lower chamber and the upper chamber. The lower chamber includes a seal bag assembly that has a seal bag containing motor oil and an exterior space around the seal bag that contains high density oil that is denser than the motor oil. The upper chamber includes a volume of the high density oil at the bottom of the upper chamber and a gravity trap connected to the exterior space through an intermediate passage in the intermediate guide section. The gravity trap includes an opening submerged in the volume of high density oil in the upper chamber.

18 Claims, 5 Drawing Sheets

(58) Field of Classification Search
CPC ..... F04D 29/086; E21B 4/003; E21B 43/128; H02K 5/132; F16J 15/52
See application file for complete search history.

(56) References Cited

U.S. PATENT DOCUMENTS

| | | | | |
|---|---|---|---|---|
| 11,268,518 | B2 | 3/2022 | Semple et al. | |
| 2005/0087343 | A1* | 4/2005 | Du et al. | F04D 13/10 417/423.9 |
| 2009/0041596 | A1 | 2/2009 | Ponomarev et al. | |
| 2016/0076550 | A1* | 3/2016 | Collins et al. | F16J 15/002 277/336 |
| 2020/0095992 | A1* | 3/2020 | Semple et al. | F04D 13/062 |

OTHER PUBLICATIONS

ISA/US International Search Report and Written Opinion for PCT/US2023/30393 mailed Nov. 16, 2023.

* cited by examiner

SEAL CONFIGURATION FOR HIGH DENSITY LUBRICATION OILS

RELATED APPLICATIONS

This application claims the benefit of U.S. Provisional Patent Application Ser. No. 63/398,527 filed Aug. 16, 2022 and entitled "Seal Configuration for High Density Lubricating Oils," the disclosure of which is herein incorporated by reference.

FIELD OF THE INVENTION

This invention relates generally to the field of submersible pumping systems, and more particularly, but not by way of limitation, to an improved seal section for use with a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Each of the components and sub-components in a submersible pumping system must be engineered to withstand the inhospitable downhole environment, which includes wide ranges of temperature, elevated pressures and corrosive well fluids.

Components commonly referred to as "seal sections" protect the electric motors and are typically positioned between the motor and the pump. In this position, the seal section provides several functions, including transmitting torque between the motor and pump, restricting the flow of wellbore fluids into the motor, protecting the motor from axial thrust imparted by the pump, and accommodating the expansion and contraction of the dielectric motor lubricant as the motor moves through thermal cycles during operation. Many seal sections employ seal bags to accommodate the volumetric changes and movement of fluid in the seal section. Seal bags can also be configured to provide a positive barrier between clean lubricant and contaminated wellbore fluid.

Although generally effective for many applications, a conventional seal bag assembly may be insufficient for preventing the contamination of motor lubricants in critical applications. There is, therefore, a need for an improved seal section that overcomes the deficiencies of the prior art. It is to this and other needs that the disclosed embodiments are directed

SUMMARY OF THE INVENTION

In some embodiments, the present disclosure is directed to a seal section for use in a downhole submersible pumping system. The seal section includes a lower chamber, an upper chamber and an intermediate guide section between the lower chamber and the upper chamber. The lower chamber includes a seal bag assembly that has a seal bag containing motor oil and an exterior space around the seal bag that contains high density oil that is denser than the motor oil. The upper chamber includes a volume of the high density oil at the bottom of the upper chamber and a gravity trap connected to the exterior space through an intermediate passage in the intermediate guide section. The gravity trap includes an opening submerged in the volume of high density oil in the upper chamber.

In other embodiments, the present disclosure is directed to a seal section for use in a downhole submersible pumping system deployable in a wellbore where the seal section includes a lower chamber, an intermediate guide section, and an upper chamber. The lower chamber includes a first separation mechanism and an exterior space around the first separation mechanism that contains high density oil that is denser than the motor oil. The intermediate guide section includes an intermediate passage in fluid communication with the exterior space surrounding the first separation mechanism. The upper chamber is above the intermediate guide section and includes a volume of the high density oil at the bottom of the upper chamber. The first separation mechanism can be a seal bag assembly.

In other embodiments, the present disclosure is directed to a downhole pumping system useable for recovering fluids from a wellbore. The pumping system includes a motor, a pump driven by the motor, and a seal section between the pump and the motor. The seal section includes a lower chamber, an upper chamber, and an intermediate guide section between the upper chamber and the lower chamber. The lower chamber includes a seal bag assembly that comprises a seal bag that contains motor oil. An exterior space around the seal bag contains high density oil that is denser than the motor oil. The upper chamber includes a volume of the high density oil at the bottom of the upper chamber and a volume of low density oil above the volume of high density oil.

WRITTEN DESCRIPTION

Figure 1:
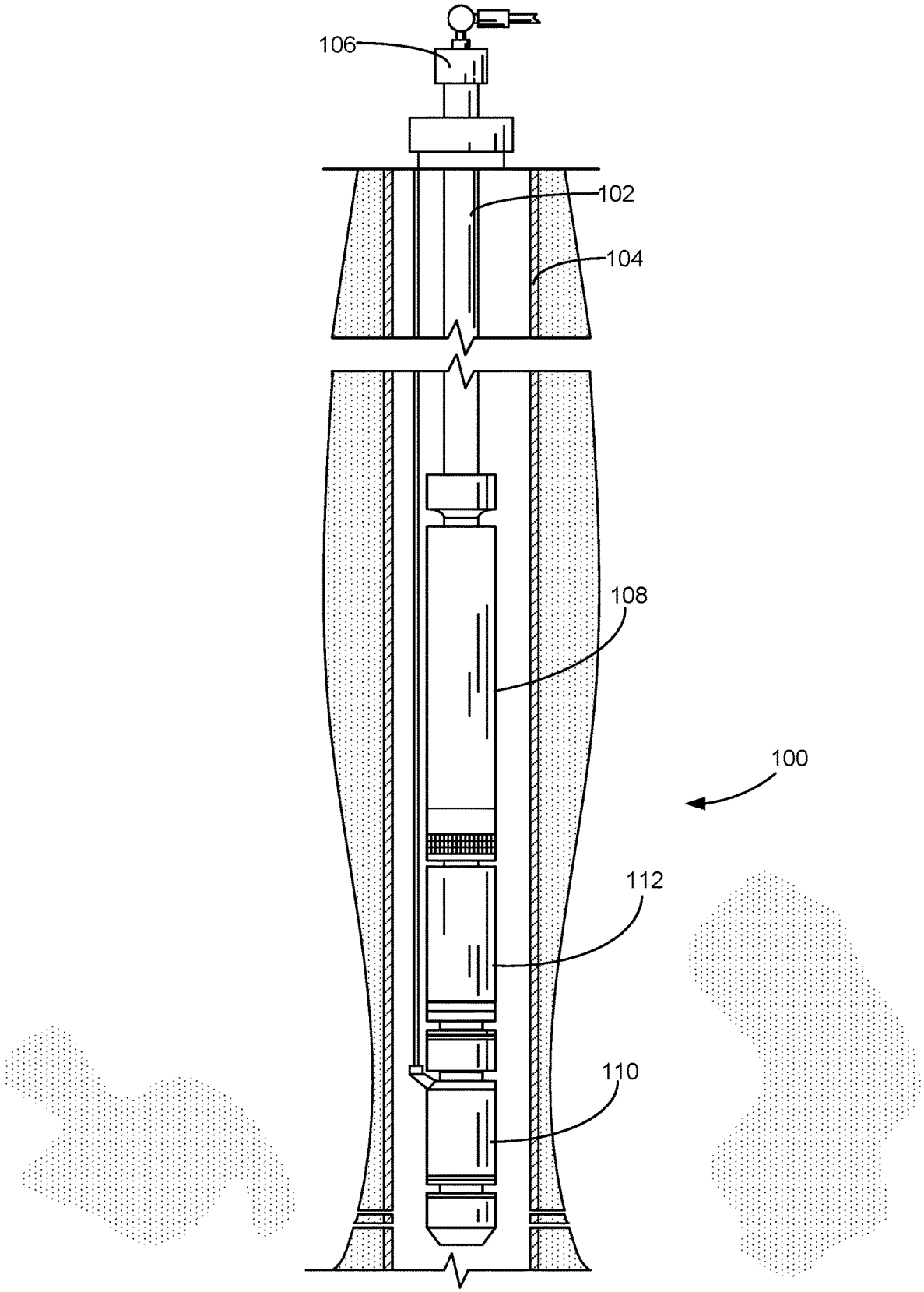
FIG. 1 is a front elevational view of a downhole pumping system constructed in accordance with an exemplary embodiment.

In accordance with exemplary embodiments of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas.

As depicted in FIG. 1, the pumping system 100 includes a pump 108, a motor 110, and a seal section 112. The production or coiled tubing 102 connects the pumping system 100 to a wellhead 106 located on the surface (which may be an onshore well pad or an offshore production platform). Although the pumping system 100 is primarily designed to pump petroleum products, it will be understood that the pumping system 100 can also be used to move other fluids. It will be further understood that although each of the components of the pumping system 100 are primarily disclosed in a submersible application, some or all of these components can also be used in surface pumping operations.

The motor 110 receives power from a surface-based facility through one or more power cables. Generally, the motor 110 is configured to drive the pump 108. In some embodiments, the pump 108 is a turbomachine that uses one or more impellers and diffusers to convert mechanical energy into pressure head. In alternate embodiments, the pump 108 is configured as a positive displacement pump. The pump 108 transfers a portion of this mechanical energy to fluids within the wellbore 104, thereby causing the wellbore fluids to move through the production tubing 102 to the surface.

The seal section 112 shields the motor 110 from mechanical thrust produced by the pump 108. The seal section 112 is also configured to prevent the introduction of contaminants from the wellbore 104 into the motor 110. Although only one pump 108, seal section 112 and motor 110 are shown, it will be understood that the downhole pumping system 100 could include additional pumps 108, seals sections 112 or motors 110.

Figure 2:
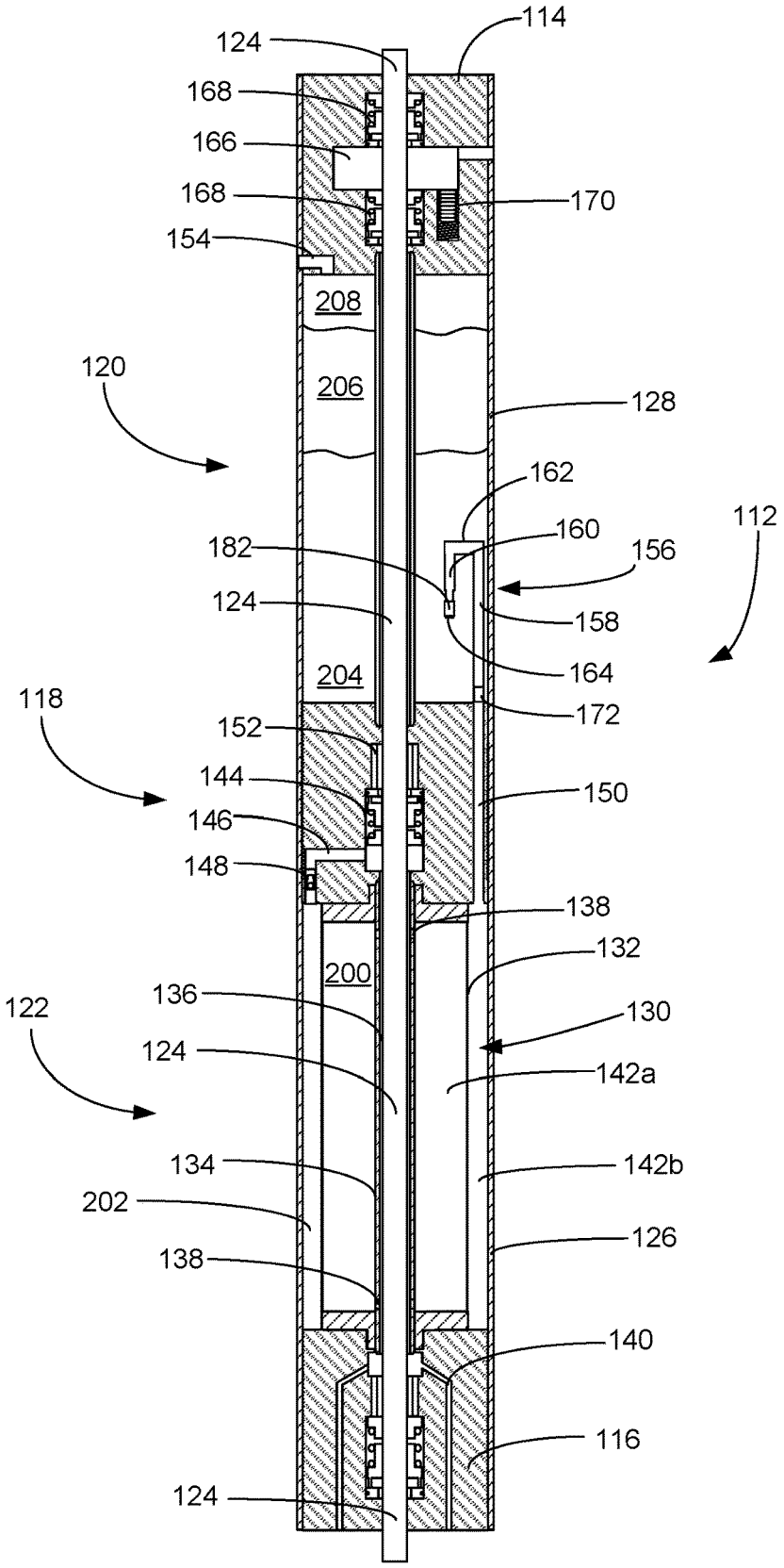
FIG. 2 is an elevational view of a seal section constructed of the pumping system of FIG. 1.

Referring now to FIG. 2, shown therein is an elevational view of the seal section 112. The seal section 112 includes a head 114, a end module 116 and an intermediate guide section 118. The seal section 112 includes an upper chamber 120 and a lower chamber 122 which are separated by the guide section 118. The head 114 is configured for connection to the pump 108 and the end module 116 is configured for connection to the motor 110. Although the seal section 112 depicted in FIG. 2 includes an upper chamber 120 and a lower chamber 122, it will be appreciated that in other embodiments, the seal section 112 can include additional chambers and intermediate guide sections 118. The seal section 112 includes a shaft 124 that extends through the seal section 112 to deliver torque from the motor 110 to the pump 108.

The lower chamber 122 includes a lower chamber housing 126 that is configured for threaded connections between the guide section 118 and the end module 116. Similarly, the upper chamber 120 includes an upper chamber housing 128 that is configured for threaded connections between the guide section 118 and the head 114. In both cases, the upper chamber housing 128 and the lower chamber housing 126 include separation mechanisms designed to prevent wellbore fluids from contaminating lubricants in the motor 110.

Figure 3:
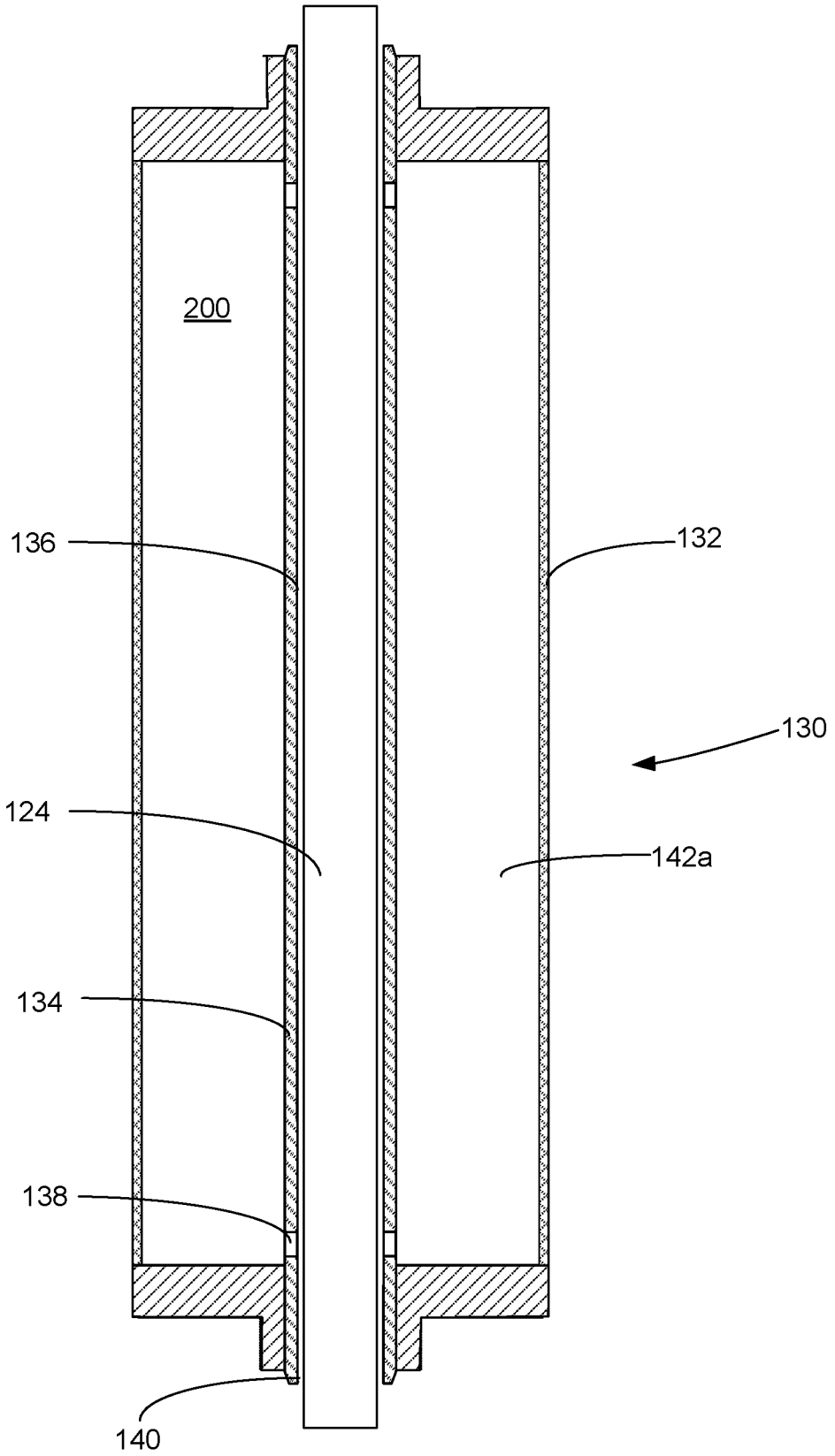
FIG. 3 is an isolated view of the seal bag assembly of the seal section of FIG. 2.

The lower chamber 122 includes a first separation mechanism, which is a seal bag assembly 130 in the embodiment depicted in FIGS. 2 and 3. The seal bag assembly 130 includes a seal bag 132 secured to a bag support tube 134, which surrounds the shaft 124. The bag support tube 134 defines an inner annular space 136 between the bag support tube 134 and the shaft 124. The bag support tube 134 includes one or more bag ports 138 that communicate fluid between the inner annular space 136 and the interior of the seal bag 132. The inner annular space 136 is in fluid communication with motor lubricant in the motor 110 through one or more lubricant channels 140 that extend through the end module 116 to the motor 110. In this way, motor lubricant expanding from the motor 110 is directed through the lubricant channels 140 into the interior of the seal bag 132 through inner annular space 136 and bag ports 138 of the bag support tube 134. In some embodiments, the seal bag 132 is fabricated from one or more fluoroelastomers such as AFLAS (tetrafluoroethylene/propylene) or PFA (perflouroalkoxy), which are commercially available from a number of sources.

The seal bag 132 defines a seal bag interior space **142*a* that can be partially or completely filled with a motor lubricant oil, such as CL400. In this way, the seal bag interior space 142*a* acts as a reservoir of clean motor oil that can be exchanged during use with fluid inside the motor 110**. The motor oil is typically lighter (less dense) than water, with a density of about 0.8 kg/liter.

The seal bag 132 also defines a seal bag exterior space **142*b* between the seal bag and the lower chamber housing 126. In contrast to the seal bag interior space 142*a*, the seal bag exterior space 142*b* is partially or completely filled with a high density oil. As used herein, the term "high density oil" refers to an oil with a density greater than 1 kg/liter. Suitable high density oils include perfluoropolyether (PFPE) oils. In some embodiments, the high density oil is a chemically inert PFPE oil with a density of between about 1.5 kg/liter and 2.0 kg/liter. High density oils with a density of about 1.8 to 1.9 kg/liter may be particularly suitable for certain applications. In this way, the lower chamber 122 includes a volume of light motor oil within the seal bag interior space 142*a* and a volume 202 of high density oil within the seal bag exterior space 142*b* surrounding the exterior of seal bag 132**. In other embodiments, the high density oil is one or more of the following PFPE (perfluoropolyether), HFE (hydrofluorother), PFC (perfluorocarbon), PF Polymer (polyfluorene polymer), FK (fluoroketone), PF Alcene (polyfluorene alcene), and Perfluoro methyl pentene.

The movement of the lighter motor oil out of the seal bag 132 is confined within the inner annular space 136 until it reaches the intermediate guide section 118. There, an intermediate shaft seal 144 diverts the light motor oil through a return port 146 to the seal bag exterior space **142*b* within the lower chamber 122. The return port 146 optionally includes a return check valve 148 to prevent the reverse flow of fluid through the return port 146. The return port 146 and return check valve 148 protect the seal bag 132 from an overpressure condition by allowing excessive fluid pressure in the seal bag 132 to be released into the seal bag exterior space 142*b***.

The intermediate guide section 118 also includes an intermediate passage 150 that connects the upper chamber 120 with the seal bag exterior space **142*b* in the lower chamber 122**.

The intermediate guide section 118 optionally includes a shaft bearing 152 adjacent to the intermediate shaft seal 144.

The upper chamber 120 is configured as a density-controlled fluid barrier chamber that includes a third volume 204 of high density oil below a fourth volume 206 of lower density fluid. The differences in the densities between the high density oil in the third volume 204 and the lower density fluid in the fourth volume 206 prevent these fluids from mixing or forming emulsions or blends. The third volume 204 of high density fluid is in fluid communication with the volume 202 of high density fluid through the intermediate passage 150. Thus, in most embodiments, the volumes 202 and 204 of high density fluids are presented as a combined volume through the intermediate passage 150.

Figure 4A:
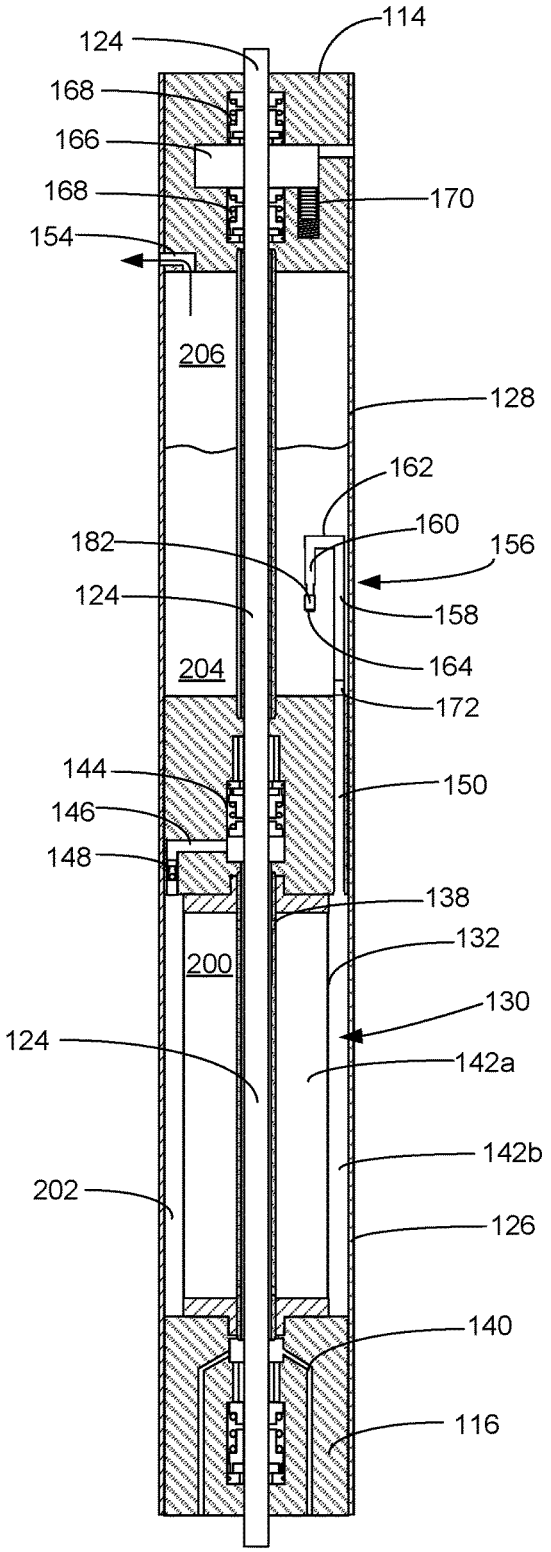
FIG. 4A is an elevational view of the seal section of FIG. 2 illustrating the discharge of fluid into the wellbore from the upper chamber of the seal section.
Figure 4B:
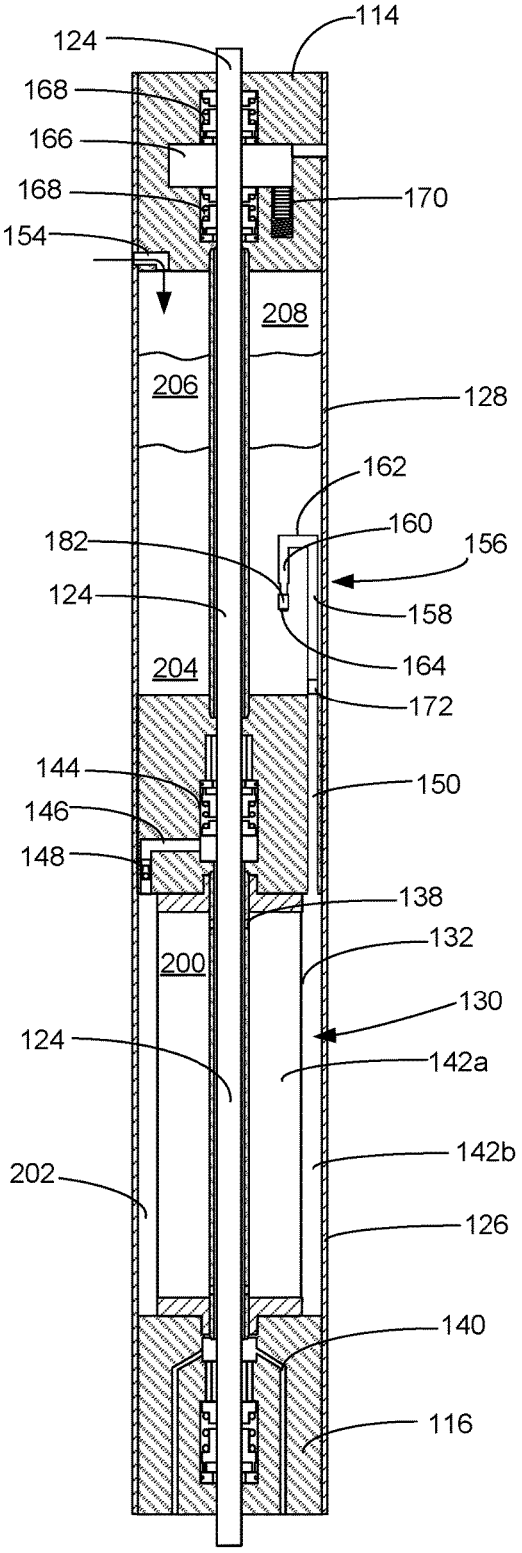
FIG. 4B is an elevational view of the seal section of FIG. 2 illustrating the ingestion of wellbore fluids into the upper chamber of the seal section.

As the pumping system 100 operates and undergoes thermal cycling, the motor oil may be expelled into the wellbore 104 through an exchange port 154 between the upper chamber 120 and the wellbore 104, as depicted in FIG. 4A. As the motor 110 cools and the motor oil contracts, wellbore fluids may be drawn into the upper chamber 120 through the exchange port 154, as depicted in FIG. 4B. The exchange port 154 can include filters or valves to limit the ingress of solid particles into the upper chamber 120. Over time, however, a fifth volume 208 of low density motor oil may accumulate above the fourth volume 206 of wellbore fluids within the upper chamber 120.

Although the fourth volume 206 of lower density fluids can initially be a relatively homogenous volume of motor oil that is the same or similar to the motor oil present in the seal bag 132, during use the lighter fluids in volumes 206 and 208 may incorporate wellbore fluids with a density of about 1 kg/liter drawn through the exchange port 154 and lighter motor oil that reaches the upper chamber 120 through the intermediate passage 150. It will be appreciated that the first volume 200, second volume 202, third volume 204, fourth volume 206 and fifth volume 208 may fluctuate over time. However, the second and third volumes 202, 204 of high density oil are unlikely to change significantly during use.

The upper chamber also includes a gravity trap 156 connected to the intermediate passage 150. As depicted in FIG. 2, the gravity trap 156 includes a first end 158 with a vertical component connected to the intermediate passage 150, a second end 160 with a vertical component, and a central section 162 that connects the first end 158 and the second end 160. The second end 160 includes an opening 164 that is submerged within the third volume 204 of high density oil in the upper chamber 120.

Although the entire gravity trap 156 is depicted as being submerged within the volume of high density oil in the upper chamber 120, it will be appreciated that the gravity trap 156 could be configured such that central section 162 is above the high density oil while the opening 164 remains submerged within the high density oil. In other embodiments, the gravity trap 156 includes additional turns or chambers that act to further discourage the downward migration of lighter fluids such as less dense wellbore fluids into the lower chamber 122. In this way, the gravity trap 156 provides a confined interface between the high density oil (e.g., volumes 202 and 204) and lighter fluids from the motor (e.g., volume 200 in the seal bag 132 and volume 206 in the upper chamber 206) and wellbore fluids (e.g., volume 208 in the upper chamber 120). To further prevent contamination of the fluids in the lower chamber 122, one or more particulate filters 182 can optionally be fitted to the gravity trap 156 or the intermediate passage 150.

In this way, the high density oil 204 and gravity trap 156 cooperate to act as an effective barrier against the migration of lighter wellbore fluids 206 into the lower chamber 122 through the intermediate passage 150. Any wellbore fluids that migrate along a leak path surrounding the shaft 124 are diverted through the return port 146 into the second volume 202 of high density motor oil surrounding the seal bag 132. The lighter wellbore fluids remain buoyant above the high density oil, which prevents further migration toward the motor 110.

To further discourage movement of wellbore fluids along the shaft 124, the head 114 can be configured to include a positive pressure chamber 166 between two head shaft seals 168. The positive pressure chamber 166 can include a volume high density oil, such as perfluoropolyether (PFPE) oil, and a positive pressure module 170. The positive pressure module 170 can be a spring-charged bellows that applies a positive pressure to the high density oil that is greater than well fluid pressure on the exterior of the upper chamber housing 128. The pressurized high density oil acts as a barrier fluid to prevent the ingress of lower pressure wellbore fluids from the pump 108 in the event the upper head shaft seal 168 leaks. The structure and function of the positive pressure head 114 is set forth in U.S. Pat. No. 11,268,518, the disclosure of which is herein incorporated by reference.

Figure 5:
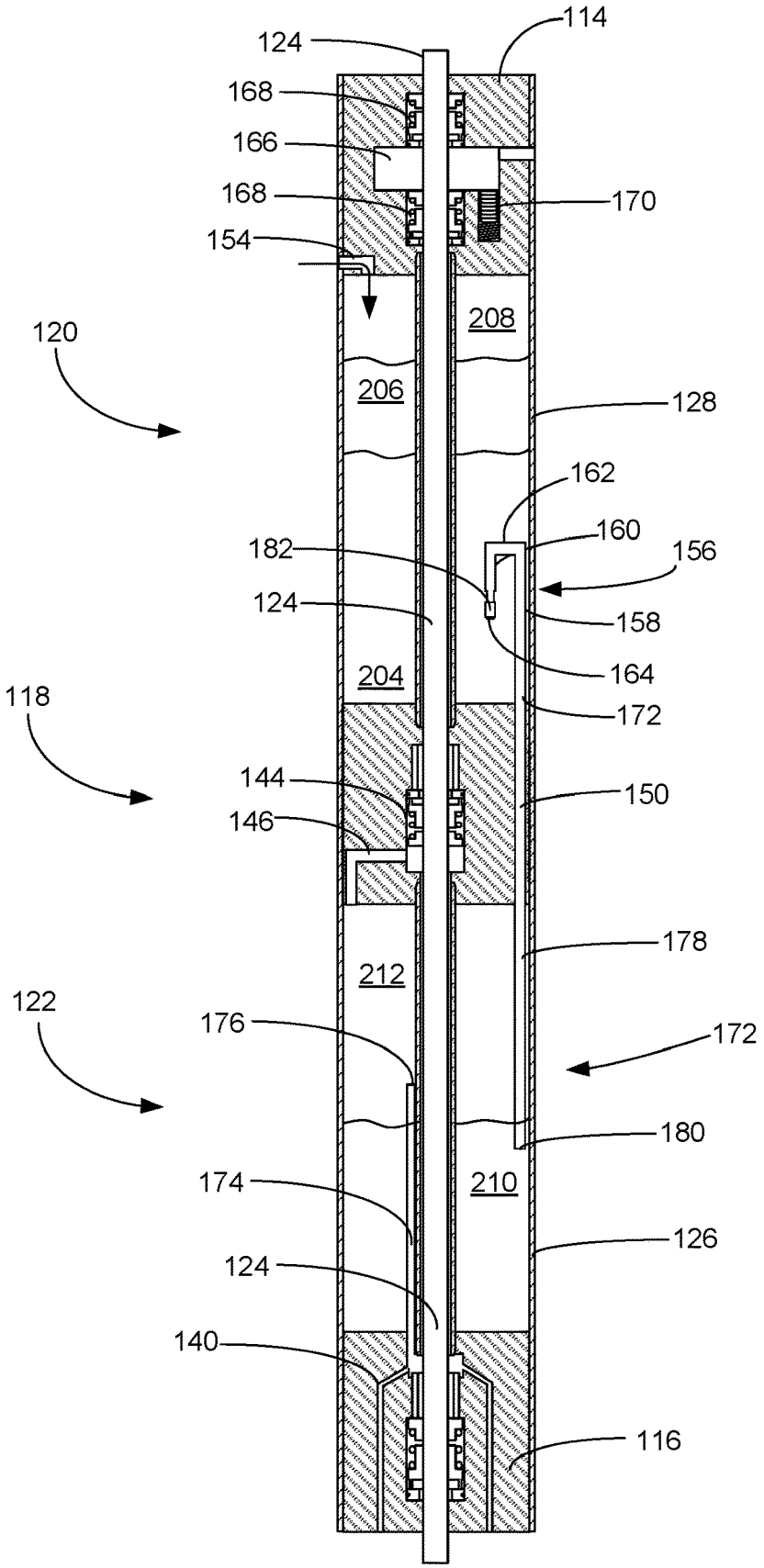
FIG. 5 is an elevational view of an embodiment of the seal section in which the lower chamber includes a multifluid labyrinth system.

Turning to FIG. 5, shown therein is an embodiment in which the lower chamber 122 includes a multifluid labyrinth system 172 in place of, or in addition to, the seal bag assembly 130. The multifluid labyrinth system 172 includes a labyrinth lower volume 210 of high density oil below a labyrinth upper volume 212 of lighter density oil, such as motor oil, which are both contained within the lower chamber housing 126 of the lower chamber 122. The multifluid labyrinth system 172 includes a lower inlet 174 that is connected directly or indirectly to the lubricant channels 140, or to additional separation chambers located below the lower chamber 122. The lower inlet 174 extends upward within the lower chamber 122 such that a discharge end 176 of the lower inlet 174 is immersed in the labyrinth upper volume 212 of lighter density oil when the labyrinth upper volume 212 and labyrinth lower volume 210 are within design specifications.

The multifluid labyrinth system 172 also includes an upper inlet 178 that is connected directly or indirectly to the intermediate passage 150. The upper inlet 178 extends downward through the labyrinth upper volume 212 into the labyrinth lower volume 210, such that a discharge end 180 of the upper inlet is immersed in the labyrinth lower volume 210 when the labyrinth upper volume 212 into the labyrinth lower volume 210 are within design specifications. In this way, light oils from the motor 110 are directed to the labyrinth upper volume 212, while heavier fluids are directed to the labyrinth lower volume 210. It will be understood that other separation mechanisms can be used in combination with the multifluid labyrinth system 172, including the seal bag assembly 130, piston-based separation mechanisms, metal bellows-based separation mechanisms, and conventional labyrinth-based separation systems.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A seal section for use in a downhole submersible pumping system, the seal section comprising:

a lower chamber, wherein the lower chamber comprises:

a seal bag assembly that comprises a seal bag that contains motor oil; and an exterior space around the seal bag that contains high density oil that is denser than the motor oil;

an intermediate guide section above the lower chamber, wherein the intermediate guide section includes an intermediate passage in fluid communication with the exterior space surrounding the seal bag; and an upper chamber above the intermediate guide section, wherein the upper chamber comprises:

a volume of the high density oil at the bottom of the upper chamber; and a gravity trap, wherein the gravity trap comprises:
a first end connected to the intermediate passage;
a second end with an opening submerged in the volume of high density oil in the upper chamber; and
a central section between the first end and the second end, wherein the central section is above the opening of the second end.

2. The seal section of claim 1, wherein the high density oil is selected from the group consisting of PFPE (perfluoropolyether), HFE (hydrofluorother), PFC (perfluorocarbon), PF Polymer (polyfluorene polymer), FK (fluoroketone), PF Alcene (polyfluorene alcene), and Perfluoro methyl pentene.

3. The seal section of claim 1, wherein the seal bag assembly further comprises:
a bag support tube; and
an inner annular space between the bag support tube and a shaft passing through the bag support tube.

4. The seal section of claim 3, wherein the intermediate guide section comprises a return port connected between the inner annular space and the exterior space surrounding the seal bag.

5. The seal section of claim 1 further comprising:
an end module connected to a lower end of the lower chamber; and
a head connected to an upper end of the upper chamber.

6. The seal section of claim 5, wherein the head comprises:
an upper head shaft seal;
a lower head shaft seal; and
a positive pressure chamber disposed between the upper head shaft seal and the lower head shaft seal.

7. The seal section of claim 6, wherein the head further comprises a positive pressure module that applies a pressure to fluid inside the positive pressure chamber.

8. The seal section of claim 7, wherein the fluid inside the positive pressure chamber is high density oil.

9. A seal section for use in a downhole submersible pumping system deployable in a wellbore, the seal section comprising:
a lower chamber, wherein the lower chamber comprises:
a first separation mechanism; and
an exterior space around the first separation mechanism that contains high density oil that is denser than motor oil;
an intermediate guide section above the lower chamber, wherein the intermediate guide section includes an intermediate passage in fluid communication with the exterior space surrounding the first separation mechanism; and
an upper chamber above the intermediate guide section, wherein the upper chamber comprises:
a volume of the high density oil at the bottom of the upper chamber; and
a gravity trap, wherein the gravity-trap comprises:
a first end connected to the intermediate passage;
a second end with an opening submerged in the volume of high density oil in the upper chamber; and
a central section between the first end and the second end, wherein the central section is above the opening of the second end.

10. The seal section of claim 9, wherein the first separation mechanism is a seal bag assembly.

11. The seal section of claim 10, wherein the seal bag assembly comprises a seal bag that includes a seal bag interior space.

12. The seal section of claim 11, wherein the seal bag interior space is filled with a motor oil.

13. The seal section of claim 12, wherein the motor oil has a density of less than 1 kg/liter.

14. The seal section of claim 10, wherein the first separation mechanism is a multifluid labyrinth system that comprises:
a labyrinth lower volume of a high density oil; and
a labyrinth upper volume above the labyrinth lower volume, wherein the labyrinth upper volume comprises lighter density oil.

15. The seal section of claim 10, wherein the first separation mechanism is selected from the group consisting of piston-based separation mechanisms and metal bellows-based separation mechanisms.

16. A downhole pumping system useable for recovering fluids from a wellbore, the pumping system comprising:
a motor;
a pump driven by the motor; and
a seal section between the pump and the motor, wherein the seal section comprises:
a lower chamber, wherein the lower chamber comprises:
a seal bag assembly that comprises a seal bag that contains motor oil; and
an exterior space around the seal bag that contains high density oil that is denser than the motor oil; and
an upper chamber above the lower chamber, wherein the upper chamber comprises:
a volume of the high density oil at the bottom of the upper chamber; and
a gravity trap, wherein the gravity-trap comprises:
a first end in fluid communication with the high density oil in the exterior space around the seal bag;
a second end with an opening submerged in the volume of high density oil in the upper chamber; and
a central section between the first end and the second end, wherein the central section is above the opening of the second end.

17. The pumping system of claim 16, wherein the seal section further comprises an intermediate guide section between the upper chamber and the lower chamber, and wherein the intermediate guide section comprises an intermediate passage that places the volume of high density oil at the bottom of the upper chamber in fluid communication with the high density oil in the exterior space around the seal bag in the lower chamber through the gravity trap.

18. The pumping system of claim 17, wherein the seal section further comprises a shaft that transmits torque from the motor to the pump.

* * * * *